United States Patent [19]

Yaeger

[11] Patent Number: 4,466,615

[45] Date of Patent: Aug. 21, 1984

[54] APPARATUS FOR PLAYING GAME

[76] Inventor: Michael J. Yaeger, P.O. Box 4304, Pioneer Sq. Station, Seattle, Wash. 98104

[21] Appl. No.: 412,949

[22] Filed: Aug. 30, 1982

[51] Int. Cl.[3] ..... A63F 1/00; A63F 9/12

[52] U.S. Cl. ..... 273/292; 273/157 R; 273/275

[58] Field of Search ..... 273/157 R, 275, 292

[56] References Cited

U.S. PATENT DOCUMENTS

| | | | |
|---|---|---|---|
| 932,206 | 8/1909 | West | 273/157 R |
| 3,309,092 | 3/1967 | Hardesty | 273/157 R X |

FOREIGN PATENT DOCUMENTS

| | | | |
|---|---|---|---|
| WO81/01523 | 6/1981 | PCT Int'l Appl. | 273/157 R |
| 512544 | 9/1939 | United Kingdom | 273/292 |

*Primary Examiner*—Anton O. Oechsle
*Attorney, Agent, or Firm*—Christensen, O'Connor, Johnson & Kindness

[57] ABSTRACT

An apparatus for playing a game is provided that includes a plurality of cards or tiles upon one surface of which is formed a representation of a portion of a typically elongate subject, which can be either a plant, animal or inanimate object. The tiles are adapted to be placed upon a flat playing surface of predetermined area such that the tiles when placed adjacent one another form a complete picture of the subject in as realistic a posture as is feasible, utilizing two-dimensional illustrations. The tiles are marked such that the representation has a different indicia at its beginning from that at its end, so that the tiles can be placed in a correlative relationship with regard to the markings on the ends of the representation on each tile. In a preferred embodiment of the game apparatus, the tiles each bear a portion of a representation of a snake and the tiles when placed in correlative relationship on the playing surface form a completed picture of a snake. The tiles are adapted to be placed in overlying relationship to one another so that the final representation of the object crosses over itself to depict as closely as possible, using two-dimensional illustrations, the snake in its naturally occurring state.

7 Claims, 6 Drawing Figures

APPARATUS FOR PLAYING GAME

BACKGROUND OF THE INVENTION

This invention relates to game apparatus and more particularly relates to apparatus for playing a game whereby a representation of an object, plant or animal in a realistic posture is constructed by the players through placement of playing cards or tiles.

Games in which the players alternately place blocks, cards, or tiles adjacent already-played blocks or tiles on a playing surface in such a way that a predetermined correlative relationship exists between the played block and the block being played exist in the prior art. An example of such a game is "dominoes". In "dominoes", the number of dots on a portion of the block is matched to the number of dots on a portion of a second block and the arrangement of blocks on the playing surface is such that a relationship exists between adjacent dominoes in accordance with the dots located on the surface thereof. As the dominoes are placed on the playing surface, they form a random pattern generally consisting of perpendicular and parallel straight lines, depending on the sequence in which they are placed. Similar games with varying shapes of playing pieces, such as triangles, or even octagons, have been produced in the past.

SUMMARY OF THE PRESENT INVENTION

In accordance with the principles of the present invention, a game apparatus is provided that includes a plurality of playing pieces such as cards or tiles upon one surface of which is formed a representation of a portion of a subject, such as a plant, animal or inanimate object. For purposes of explanation, the playing pieces will be referred to as tiles, however, any object having a flat surface upon which a picture can be placed will work. The tiles are adapted to be placed upon a flat playing surface adjacent one another in a predetermined correlative relationship so that as the tiles are placed in said correlative relationship, a complete representation of the subject in a realistic posture is formed from the portions of the representation present on each of the tiles. To achieve this end, the tiles are adapted to overlap or cross over others that have previously been played, thereby creating a realistic picture of the subject represented (such as a snake coiling on top of itself).

In a preferred embodiment of the game apparatus of the present invention in which the tiles form a representation of an elongate object, such as a snake, the portions of the snake represented on each individual block or tile are arranged so that the direction of the pattern of the snake is determined by which of the tiles is placed. On a first portion of the tiles, the snake representation is such that it maintains the direction of the snake's body the same as that of the last placed tile. On a second portion of the tiles the snake segment represented is such as to change the direction of the snake's body. Some of the tiles of the second portion reverse the direction of the snake while others turn the snake at right angles to the direction provided by the last played tiles.

One of the tiles bears a representation of the beginning of the subject represented and another of the tiles bears a representation of the end of the subject being represented so that these tiles mark the beginning and end of play of the game. In the preferred embodiment of the invention in which a snake is depicted, one tile bears a picture of the head of the snake and a second tile bears a representation of the tail of the snake. The representation of the snake on the tiles is such that at any given time placement of the head tile adjacent the last played tile will cause the head of the snake to face in one of four directions.

In the preferred embodiment the tiles are rectangular and the illustration on the tile begins and ends at an edge of the tile. On the first portion of the tiles the illustration begins at a first edge and ends at a second, opposing edge. On the tiles that reverse the direction of the picture being formed by the players as they place the tiles on the playing surface, the illustration begins and ends at the same edge of the tile. On the tiles that change the direction of the object illustration at right angles to the last placed tile, the illustration begins at the first edge and ends at an adjacent edge, either right or left as viewed by the player.

Also in the preferred embodiment, the beginning of the illustration portion on each tile is colored differently from the end of the illustration portion on that tile. The tiles are placed adjacent one another on the playing surface so that the colors of the illustration portion on the contiguous edges of adjacent tiles match.

BRIEF DESCRIPTION OF THE DRAWINGS

The objects and advantages of the present invention will be better understood by those of ordinary skill in the art and others upon reading the ensuing specification when taken in conjunction with the appended drawings wherein.

DETAILED DESCRIPTION OF THE PREFERRED EMBODIMENT

The Equipment

The game of the present invention preferably utilizes a set of tiles 10 upon which portions of an elongate object are pictures. For example, in the illustrated embodiment, each of the tiles 10 has pictured thereon a portion of a snake. The illustrated tiles are rectangular in shape, however, it would also be possible to use square tiles, although rectangular tiles lend to the ability to make the pictured object appear more natural, since the object is generally a long, narrow object, such as a snake or a train. The tiles 10 are adapted to be placed edge to edge, so that in assembly they create the appearance of a total snake. One of the tiles 10*a* bears an illustrtion of the head of the snake, whereas another tile 10*b* bears an illustrtion of the tail of the snake. The remaining tiles will bear illustrations of portions of the body of the snake. Except for the necessity of having one tile with the snake head illustration and one with the tail illustration, the number of remaining tiles and the orientation of the portion of the snake that those tiles bear is a matter of choice.

Figure 2A:
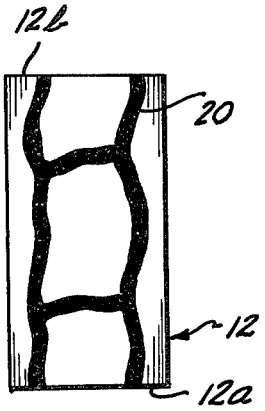
FIGS. 2A through 2D are plan views of four variations of playing pieces made in accordance with the principles of the present invention; and, FIG. 3 is an isometric view of the arrangement of playing pieces shown in FIG. 1 illustrating the cross-over of the playing pieces.
Figure 2B:
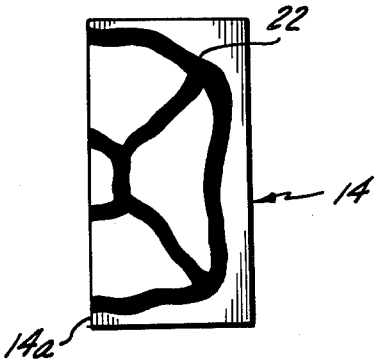

In FIGS. 2A through 2D there are illustrated four tiles, 12, 14, 16 and 18, respectively. Referring to FIG. 2A, the body portion illustration 20 begins at a first edge 12*a* of the tile and extends across the rectangular tile along its longer dimension to terminate at a second, opposing edge 12*b*. When a tile of the type designated as 12 is placed on the playing surface, it maintains the direction of assembly of the snake in the same direction as that determined by the last played tile. Referring to FIG. 2B, the body portion illustration 22 begins at a first edge 14*a* of the tile and curves in a generally U-shape to end at the same edge 14*a*. When a tile of the type designated as 14 is placed on the playing surface, it reverses the direction of assembly of the snake from that determined by the last played tile.

Figure 1:
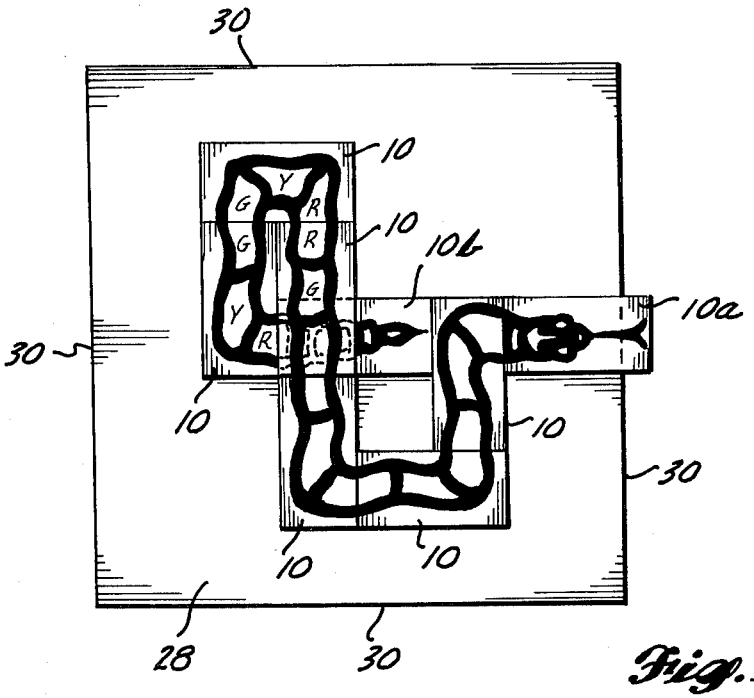
FIG. 1 is a plan view of a playing surface upon which a plurality of playing pieces made in accordance with the present invention are situated.
Figure 2C:
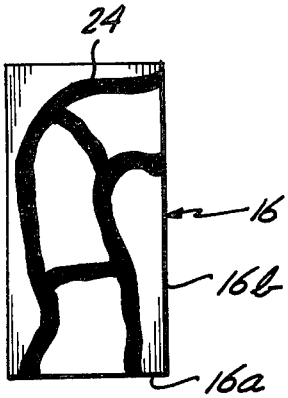
Figure 2D:
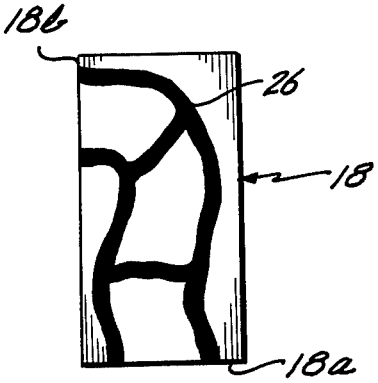

Referring to FIG. 2C, the body portion illustration 24 begins at a first edge 16*a* of the tile and continues along the long dimension of the rectangular tile for part of its length. The illustration then turn 90° and ends at a second edge 16*b* adjacent the first edge 16*a*. When a tile of the type illustrated as tile 16 is played, it will turn the direction of assembly of the snake 90° from the direction determined by the last-played tile. The tile 18 illustrated in FIG. 2D is similar to the tile 16 in that it also turns the direction of assembly of the snake 90° from the direction of the last played tile. However, the body portion illustration 26 on the tile 18 begins at a first edge 18*a* and ends at an adjacent edge 18*b* turning in the opposite direction of the body portion illustration 24 on the tile 16. As viewed in FIG. 2C, the body portion illustration 24 turns to the right while the body portion illustrtion 26 as viewed in FIG. 2D turns to the left. Each of the body portion tiles 12, 14, 16 and 18, has the segments of the body adjacent the edges of the tiles marked in a different color, that is, there is a color change in the body portion illustration from edge to edge of the tile. As an example, the segment G adjacent the first edge 12*a* of the body portion illustration 20 would be colored a first color, such as green, while the segment Y adjacent the second edge of the body portion illustration 20 would be colored a different color from the first end segment, such as yellow. In the illustrated embodiment, there is a third segment R between the edge segments G and Y, which would be colored a third color, such as red. Therefore, in total there are three different colors on the tile 12. The body portion illustrations 22, 24 and 26 on the tiles 14, 16 and 18 are similarly segmented into three colored parts as designated by the letters G, Y, and R. The use of three colors adds to the variety of play and therefore to the entertainment value of the game; however, the critical feature of the representation on the tile is that the representation must be divided into at least two colored portions so that there can be a change of color in the representation in its span from edge to edge of the tile. The match of colors as the tiles are played is illustrated in FIG. 1.

Figure 3:
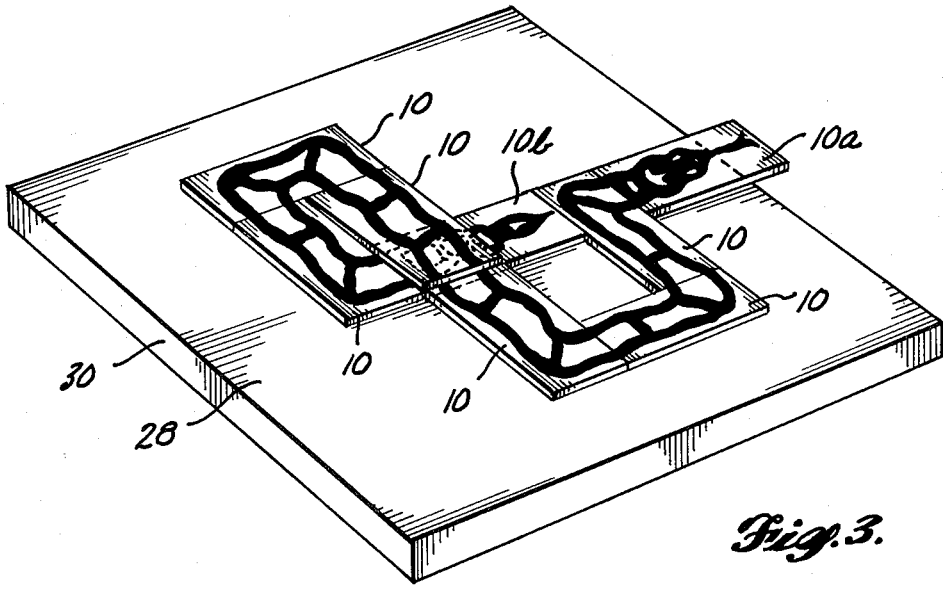

The game is played on a flat surface, such as a table or board 28, illustrated in FIGS. 1 and 3. While any flat surface will do, a predetermined area must be circumscribed on the playing surface prior to the start of the game to form boundaries 30 over while the tiles should not be allowed to cross. Some variation of the rules can be permitted to permit crossing of the boundary in certain circumstances, as will be described below.

Object of the Game

In playing the game, each of the players is assigned a certain number of tiles. The object of the game is for each of the players to utilize all of the tiles with which they are provided in alternate turns to form a complete illustration of the subject, a snake in the illustrated embodiment, on the playing surface. At the conclusion of the game when no player can play any other piece, the last piece to be played should be the head of the snake and the loser of the game is the player toward whom the snake's head faces at the final play. The object of the game is to attempt to utilize the various turning pieces in constructing the snake so that at the end of the game, the head of the snake will face toward one of your opponents. Typically a series of games is played, e.g., ten, and the winner of the series is the player who has lost the least in the ten games.

The Play of the Game

For purposes of illustration, the rules of playing the game will be described in the case of four players. It should be noted that the rules will vary slightly when two or three persons play, but the basic rules of the game will remain the same. The tiles are distributed randomly to the four players face down. Each of the players may view his own tiles, but may not view the tiles of an opposing player until that opposing player plays the tiles on the playing surface. After the tiles have been distributed, the player having the tail tile, that is, the tile upon which the snake's tail is illustrated, places the tile on the playing surface with the illustration side up, in the central portion of the playing surface with the broad end of the tail illustration facing to the left. The player to the left of the starting player, then adds the next tile. Since the tail tile is not color coded, the second player is free to add any tile in his collection, except for the "head" tile, that is, the tile upon which the snake's head is illustrated. Once the second player has placed a tile, it is then up to the third player, which at this point would be the player sitting opposite the beginning player, to match the edge color of the played tile with one of his tiles having an edge color the same as the open edge of the last played tile. When the third player plays his tile it will either maintain the direction of the snake in the same direction, turn the snake's body to the right or left, or reverse the snake's direction depending on the type of body tile that is played. Players must match the color on the edge of the body portion illustration on the tile to be played, with the color on the free edge segment of the body portion illustration on the tile last played. If a player cannot match the color, he must pass until such time as his turn arrives and he can match color with the last tile played. A player must play a tile if he can, even though it will result in pointing the snake toward himself.

The play continues around from player to player, each player adding the appropriate tile to the snake on the playing surface and attempting to direct the snake away from himself toward an opposing player. Only when all of the players have played their tiles, or when all the players are forced to pass because none of them can play a matching color, is the head tile placed adjacent the last played tile by whoever is holding it. The player at whom the head of the snake is pointing at the end of the game is "bitten" by the snake and loses the round of play. The winner of the game is the player with the fewest snake bites after completion of a predetermined number of rounds of play, e.g., ten.

If the tiles approach the edge of the playing surface such that placement of the next tile would force the tile to cross the boundary 28 of the playing surface, then the player holding the head tile places it at that time and the player at whom the head of the snake is facing is "bitten" and loses the round.

FIG. 3 illustrates in isometric view a typical arrangement of the tiles assembled during play of the game. FIG. 3 particularly illustrates the manner in which the tiles are adapted to crossover one another so that the snake can overlap itself as the play progresses. The ability to cross over the already played tiles makes the snake appear to be more realistic as if it were coiling on itself as a real snake would. Also, the crossover lengthens the average playing time of the game.

When four players play, it is possible to have the players sitting opposite one another joined as a partnership to combine their scores and to defend the edges of the playing surface as a team. If only two or three players play, so that there is an edge of the playing surface underfended, then not only is a player "bitten" if the snake points at him at the time the head is placed, but also, he is "bitten" if he forces the play over an undefended edge or causes the snake to face an undefended edge at the end of the game.

Although one embodiment of the game has been described and illustrated, it is clear that several changes can be made to the illustrated embodiment while remaining within the scope of the present invention. For example, the playing pieces have been described as rectangular tiles, however, they could also be cards and, as mentioned before, while the illustrated tiles depict a snake, it is possible to utilize an illustration of any elongate animal or object, such as a highway, in which case the beginning and end tiles could have starting and destination cities illustrated on them. Another possible subject for the game could be a rope or even simply a color-segmented line. Further, as was discussed above, the illustration on each playing tile or card must change color as it progresses from one edge of the tile to the other. Whether or not there is a third color segment between the two edge segments is not critical, however, three colors add greater flexibility and greater playing possibilities to the pieces.

Since many variations can be made to the illustrated and described embodiment of the present invention while remaining within the scope of the invention, the present invention should be defined solely with respect to the claims appended hereto.

The embodiments of the invention in which an exclusive property or privilege are claimed are defined as follows:

1. An apparatus for playing a game within a defined area of a planar playing surface, said game apparatus comprising:

a lead tile upon which is imprinted a representation of a first end portion of a typically elongate subject;

an end tile upon which is imprinted a representation of a second end portion of the typically elongate subject;

a plurality of body tiles upon each of which is imprinted a representation of a section of a central portion of the subject whose first and second end portions are pictured on the lead and end tiles, said lead, end, and body tiles being adapted for placement on the playing surface adjacent one another in such a manner that the lead, end, and body tiles cooperate to form a complete picture of the subject in a realistic posture, each of said representations being divided into a first segment at a first end of said representation, a second segment at a second end of said representation, and a third segment interposed between said first and second segments, each of said first, second, and third segments on any particular tile being marked with different identifying indicia and said first and second segments being marked with indicia different from one another so that a change in indicia occurs from the first end of the representation of the second end of the representation.

2. The game apparatus of claim 1 wherein the imprinted representation on said tiles is such that it determines the direction of orientation of the elongate dimension of the subject with respect to the boundaries of the playing surface and wherein a first group of the body tiles has the representation imprinted thereon in such a manner as to maintain the direction of orientation of the elongate dimension of the subject the same as the direction determined by the previously played tile, a second group of the body tiles has the representation imprinted thereon such that the direction of orientation of the elongate dimension of the subject is reversed from the direction determined by placement of the previous tile and a third group of the body tiles has the representation imprinted thereon such that the direction of orientation of the elongate dimension of the subject is turned at substantially right angles from the direction determined by the placement of the previous tile.

3. The game apparatus of claim 2 wherein said body tiles are rectangular in shape and said representation on the tiles of said first group begins at a first edge of each of said tiles, which edge is one of the shorter edges of said tile, and extends across said tile along its longer dimension, said representation ending at a second edge of said tile opposite said first edge of said tile;

said representations on the tiles of said second group begin at a first edge of each tile, which is one of the longer edges of the tile, and ends at the same edge of the tile;

said representations on the tiles of said third group begin at a first edge of each tile, which is one of the shorter edges of said tile, and end at a second edge of the tile, which is adjacent said first edge and which is one of said longer edges of the tile.

4. The game apparatus of claim 1 wherein the subject represented on said tiles is typically elongate, and which in its natural state turns and coils, said tiles being adapted for placement such that they can overlie one another so that the completed picture of said subject can cross over itself to more naturally represent the coiling and turning of the actual subject being represented.

5. The apparatus of claim 4 wherein the subject being represented in a snake, said lead tile bearing a representation of the head of the snake, said end tile bearing a representation of the tail of the snake and each of said body tiles bearing a representation of a portion of the body of the snake between said head and said tail.

6. The apparatus of claim 1 wherein said defined playing area is a square and said playing tiles are rectangles, said playing tiles being adapted for placement on said playing surface such that the edges of said tiles are substantially parallel to the sides of said square.

7. The game apparatus of claim 1 wherein said identifying indicia comprise a coloring of said tile, said first and second segments being colored a different color from one another so that a color change occurs from the first end of the representation to the second end of the representation.

* * * * *

UNITED STATES PATENT AND TRADEMARK OFFICE

CERTIFICATE OF CORRECTION

PATENT NO. : 4,466,615

DATED : August 21, 1984

INVENTOR(S) : Michael J. Yaeger

It is certified that error appears in the above-identified patent and that said Letters Patent is hereby corrected as shown below:

Column 2, line 47: "pictures" should be --pictured--
Column 2, line 58: "illustrtion" should be --illustration--
Column 3, line 15: "turn" should be --turns--
Column 3, line 28: "illustrtion" should be --illustration--
Column 3, line 57: "while" should be --which--
Column 5, line 15: "underfended" should be --undefended--
Column 6, line 6: "of" second occurrence should be --to--

Signed and Sealed this

*Twenty-first* Day of *May 1985*

[SEAL]

*Attest:*

DONALD J. QUIGG

*Attesting Officer* *Acting Commissioner of Patents and Trademarks*